United States Patent [19]

Peters

[11] Patent Number: 5,014,994

[45] Date of Patent: May 14, 1991

[54] GOLF TRAINER

[76] Inventor: Dennis W. Peters, 709 Briar La., Morris, Ill. 60450

[21] Appl. No.: 548,400

[22] Filed: Jul. 5, 1990

[51] Int. Cl.[5] ..... A63B 69/36

[52] U.S. Cl. ..... 273/187 R; 273/183 E; 273/192; 273/32 H

[58] Field of Search ..... 273/187 R, 183 D, 191 R, 273/191 A, 191 B, 192, 187 A, 187 B, 186 R, 186 C, 183 E, 32 H

[56] References Cited

U.S. PATENT DOCUMENTS

| | | | |
|---|---|---|---|
| 3,041,075 | 6/1962 | Taylor | 273/187 R |
| 3,868,116 | 2/1975 | Ford et al. | 273/187 R |
| 4,174,839 | 11/1979 | Marrs | 273/183 D |
| 4,306,723 | 12/1981 | Rusnak | 273/186 R |
| 4,413,826 | 11/1983 | Miller | 273/192 |

FOREIGN PATENT DOCUMENTS

| | | | |
|---|---|---|---|
| 1293714 | 10/1972 | United Kingdom | 273/187 R |

*Primary Examiner*—George J. Marlo
*Attorney, Agent, or Firm*—Ernest Kettelson

[57] ABSTRACT

A golf trainer to assist and train a golfer to putt properly, to hit straight drives and to "work" the ball by hitting a draw or hook when desired and a fade or slice when that is desired. The trainer includes a pair of spaced apart telescoping legs which border a guide path, slidably connected at their rearward ends and not connected at their forward ends to provide an opening for the guide path in the direction the ball is to be putted or driven. The telescoping legs may be lengthened and shortened to vary the length of the guide path, and slidably moved closer together and farther apart to vary the width of the guide path so as to correspond with the width of the head of whatever club is to be used with minimum clearance on either side. The trainer also includes a pair of length adjustable foot positioning members pivotably connected to any of a plurality of cavities in one of the telescoping legs to extend outwardly therefrom at a substantially right angle, each one of the pair being spaced apart corresponding to the distance the golfer's feet should be spaced apart when in the address position. The trainer is collapsible or retractable for carrying and storage, and easily reconstructable or extendable when desired for use.

10 Claims, 7 Drawing Sheets

GOLF TRAINER

BACKGROUND OF THE INVENTION

This invention relates to the field of training devices to assist and train golfers to improve their putting and their drives.

Various devices of this type are known to the prior art. Those known to the inventor of the present invention include those which are shown and described in the following U.S. patents:

U.S. Pat. No. 4,544,161 comprising a T-shaped member for use in perfecting drives.

U.S. Pat. No. 3,992,013 comprising a mat on which a golf ball's position can be marked.

U.S. Pat. No. 3,300,219 comprising an elongated leg projecting outwardly from between two shoe guides to adjust the distance of ball placement from where the golfer is standing.

U.S. Pat. No. 3,229,981 comprising a complex foot and ball positioning device.

U.S. Pat. No. 3,141,675 comprising another kind of ball and foot positioning device.

U.S. Pat. No. 2,189,613 comprising a platform having foot plates which are adjustable.

U.S. Pat. No. 2,025,519 comprising a foldable ruler type of device to help a golfer measure and gauge his stance.

U.S. Pat. No. 4,384,718 comprising an adjustable H-shape frame to help a golfer find the proper position for his feet when addressing the ball.

U.S. Pat. No. 2,777,697 comprising a mat or plate for the golfer's foot position and a single strip extending outwardly therefrom to indicate the ball position for each of the iron clubs and for each of the wood clubs.

U.S. Pat. No. 3,887,193 comprising an inverted L-shaped device in which the cross leg is relatively broad and has a turf like mat for positioning the golf ball, and the vertical leg is movable laterally relative to the cross leg to adjust the width of a golfer's foot position or stance.

U.S. Pat. No. 4,523,758 and 4,605,228 comprising a putter and pendulum swing method of putting.

Each of the foregoing prior art patents disclose devices which take a different approach from the present invention and are directed to somewhat different aspects of helping a golfer learn how to improve his golf game. The trainer in accordance with the present invention can be used to perfect both a golfer's putting and his drives, as well as so learn how to "work" his drives by hitting a draw or hook when desired and a fade or slice when desired. It is an all purpose type of training device incorporated into one piece of equipment or assembly which itself is uncomplicated and easy to use as well as being collapsible or compressible into a small compact unit which the golfer can carry with him in his golf bag for use at any time.

SUMMARY OF THE INVENTION

It is an object of the invention to provide a golf trainer to assist and train a golfer to improve both his putting and his drives by use of the same device.

It is an object of the invention to provide a golf trainer which is collapsible or foldable into a compact unit for storage and carrying which can be readily reconstructed, unfolded or assembled when desired to use.

It is an object of the invention to provide a golf trainer to improve both putting and driving which comprises a pair of spaced apart elongated members to define a guide path therebetween, positionable to direct its longitudinal axis in line with a selected line of travel toward the target, and adjustable to vary both the width and length of the guide path.

It is an object of the invention to provide a golf trainer to improve both putting and driving which comprises a pair of spaced apart elongated telescoping members, slidably connected at their rearward ends, and having a pair of spaced apart foot positioning members extending outwardly from one of the telescoping members for which the spaced apart distance can be adjusted and for which the length of each member of the pair can also be adjusted.

DESCRIPTION OF PREFERRED EMBODIMENT

Figure 1:
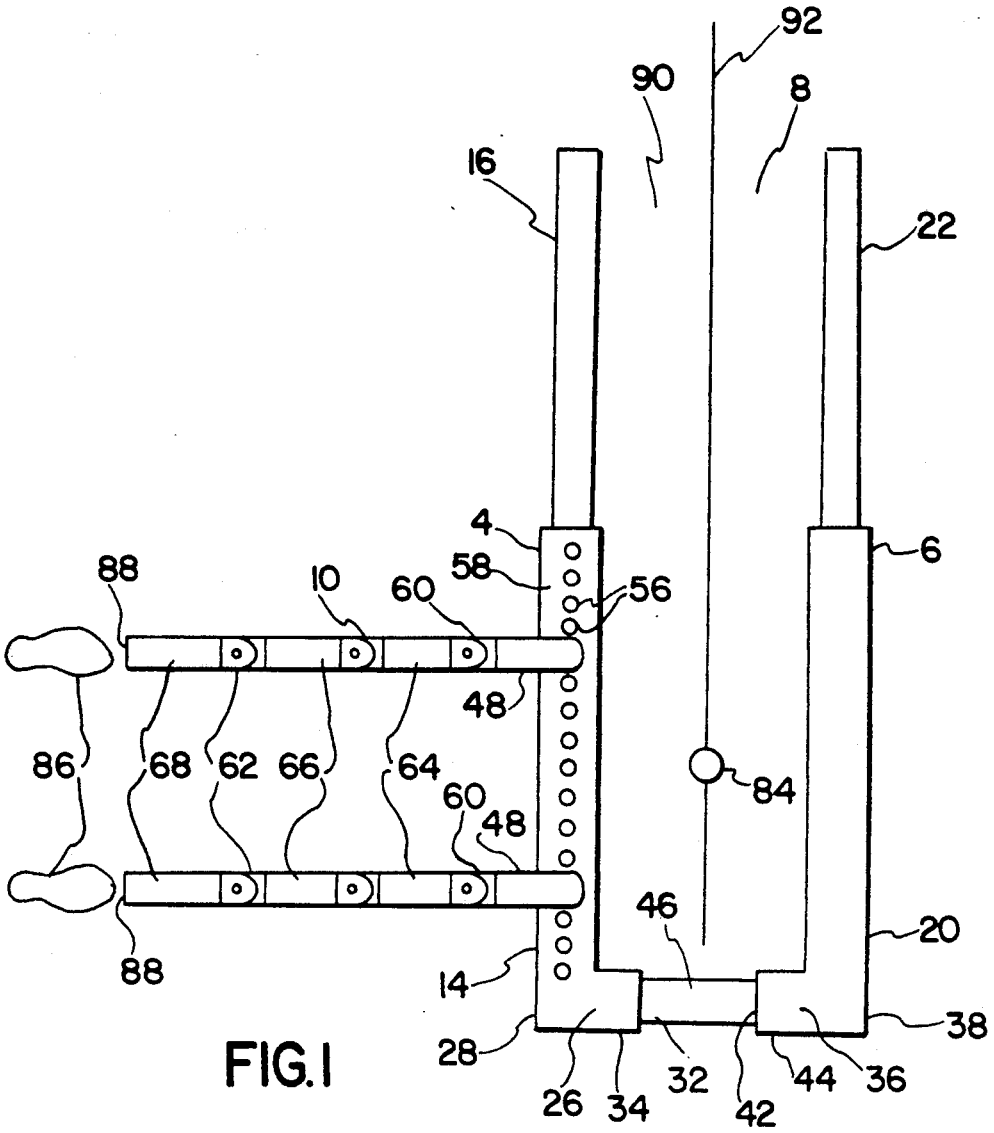
FIG. 1 is a plan view of a golf trainer in accordance with this invention, a golf ball in position for use of the trainer, and the feet of a golfer shown in position to address and strike the ball.

A golf trainer in accordance with the present invention comprises an adjustable positioning and aiming device 2 which may be disassembled and folded, having a first telescoping arm 4 and a second telescoping arm 6 to extend parallel to the first and spaced apart therefrom to provide an adjustable width guide path 8 therebetween.

A pair of foot positioning members extend outwardly from the first telescoping arm 4 in the direction away from the guide path 8, comprising a first length adjustable member 10 and a second length adjustable member 12 to extend parallel to the first length adjustable member 10 and spaced apart therefrom to provide position markers for the golfer's feet.

The first telescoping arm 4 includes an elongated sleeve member 14 and corresponding elongated insert member 16 slidable into and out of the elongated sleeve recess 18 of sleeve member 14.

The second telescoping arm 6 includes an elongated sleeve member 20 and a corresponding elongated insert member 22 slidable into and out of the elongated sleeve recess 24 of sleeve member 20.

The first telescoping arm 4 also includes a short sleeve member 26 integrally joined to and extending from the rearward end 28 of the first telescoping arm 4 and perpendicular thereto, having a corresponding short sleeve recess 30 therein opening to recess entrance 32 at the outer end 34 of the short sleeve member 26.

The second telescoping arm 6 also includes a short sleeve member 36 integrally joined to and extending from the rearward end 38 of the second telescoping arm 6 and perpendicular thereto, having a corresponding short sleeve recess 40 therein opening to recess entrance 42 at the outer end 44 of the short sleeve member 36.

The short sleeve member 26 of the first telescoping arm 4 and the short sleeve member 36 of the second telescoping arm 6 extend in the direction toward each other, their recess entrances 32 and 42 facing each other and their sleeve recesses 30 and 40 being axially aligned to slidably receive therein opposite end portions of crossbar insert 46.

The cross-sectional dimension and configuration of the elongated sleeve recesses 18 and 24 and of their respective sleeve insert members 16 and 22 correspond closely to each other to provide a frictional fit of the insert members 16 and 22 in their respective sleeve recesses 18 and 24. Such frictional fit permits sliding the insert members 16 and 22 in and out of the recesses 18 and 24, but it is a tight enough fit to frictionally hold the insert members 16 and 22 at whatever position they are moved to relative to their respective sleeve members 14 and 20.

The cross-sectional dimension and configuration of the short sleeve recesses 30 and 40 correspond closely to that of the crossbar insert 46 received therein to provide a frictional fit of the opposite end portions of crossbar insert 46 in the respective short sleeve recesses 30 and 40. Such frictional fit permits sliding the short sleeve member 26 and the first telescoping arm 4 toward and away from the short sleeve member 36 and the second telescoping arm 6 to respectively narrow and widen the guide path 8, but it is a tight enough fit to frictionally hold the short sleeve members 26 and 36 to the portion of cross-bar insert 46 received therein and their respective telescoping arms 4 and 6 at whatever spaced apart parallel position they are moved to and thereby provide the width desired of the guide path 8.

The crossbar insert 46 is removable from the short sleeve members 26 and 36 to separate the telescoping arms 4 and 6 for placing in the golfer's golf bag when not in use.

The length adjustable foot positioning members 10 and 12 are removably connected to telescoping arms 4 so they can likewise be removed therefrom for placing in the golfer's golf bag when not in use.

Each foot positioning member 10 and 12 include a connecting strip 48 having a pivot pin 50 extending downward from its downwardly facing surface 52 at its coupling end 54 to seat in a selected one of the longitudinally spaced apart apertures 56 provided along the telescoping arm 4 and opening to the upwardly facing planar surface 58 thereof. The pivot pin 50 of each connecting strip 48 of the foot positioning members 10 and 12 are seated in selected ones of the spaced apart apertures to releasably couple the foot positioning members 10 and 12 to the first telescoping arm 4 at whatever spaced apart distance selected.

Each connecting strip 48 extends from its coupling end 54 and terminates at a pivot connecting end 60. Pivot connectors 62 are provided to pivotally connect the pivot connecting end 60 of connecting strip 48 to a corresponding pivot connecting end of a first length adjustable strip 64, to also connect its opposite end to one end of a second length adjustable strip 66, to also connect the opposite end of the second length adjustable strip 66 to one end of a third length adjustable strip 68.

Additional length adjustable strips can be provided if desired. In the embodiment shown and described herein, each one of the length adjustable strips are about seven inches in length and when each is pivoted to extend outwardly from the one to which it is connected in full longitudinal axial alignment, they together with connecting strip 48 of comparable length extend about twenty eight inches.

Pivot connectors 62 comprise a pair of strip receiving sleeve members 70 and 72 pivotally connected together at their adjacent ends by pivot pin 74 terminating at their opposite ends 76 and 78 in strip receiving apertures to receive the respective ends of the length adjustable strips 64, 66 and 68 and the pivot connecting end of connecting strip 48 in respective ones of the strip receiving recesses of sleeve members 70 and 72, and to hold them securely therein.

The sleeve member 70 is connected to rotate in a plane above sleeve member 72, whereby sleeve member 70 may be rotated in a complete three hundred and sixty degree circle around sleeve member 72. Thus the length adjustable strips 64, 66 and 68 are connected to pivot connectors 62 so as to each be pivotable to a folded position in which each overlie the others and also overlie connecting strip 48, to a first length adjustable position in which strip 64 is pivoted to extend outwardly from and in longitudinal axial alignment with connecting strip 48, to a second length adjustable position in which strip 66 is pivoted to extend outwardly from and in axial alignment with strip 64, and to a third length adjustable position in which strip 6 is pivoted to extend outwardly from and in axial alignment with strip 66.

To use the golf trainer in accordance with this invention, the unit is assembled by first inserting the opposite ends of crossbar insert 46 into respective ones of the short sleeve recesses 30 and 40 to couple the first and second telescoping arms 4 and 6 together at a predetermined spaced apart distance to obtain the desired width of the guide path 8 therebetween.

Such width is determined by the corresponding width of the golf club head 80 that is going to be used with the trainer, the width of guide path 8 preferably being just slightly greater than the width of the face 82 of club head 80, for example about an inch or less wider to provide about a half inch or less clearance on each opposite side of the club face 82 between it and the telescoping arms 4 and 6 bordering each opposite side of the guide path 8.

The foot positioning members 10 and 12 are next coupled to the telescoping arm 4 having the spaced apart apertures 56 by seating the pivot pins 50 of each in selected ones of such spaced apart apertures 56. The distance foot positioning members 10 and 12 are spaced apart when coupled to telescoping arm 4 corresponds to the distance the golfer's feet 86 are to be spread apart when addressing the golf ball 84.

The next step is to unfold the desired number of length adjustable strips 64, 66 and 68 of each foot positioning member 10 and 12 to get the predetermined distance the golfer's feet are to be from the ball 84. The golfer's feet are to be directly behind the outer end 88 of respective ones of the foot positioning members 10 and 12, with the toes of each foot immediately adjacent thereto.

The unfolded strips of the foot positioning members 10 and 12 are arranged to extend perpendicular to the telescoping arm 4 to which they are coupled.

The telescoping arms 4 and 6 are arranged to extend parallel to each other.

The elongated insert members 16 and 22 are pulled outwardly from their respective recesses 18 and 24 of the telescoping arms 4 and 6 a predetermined distance to lengthen the guide path 8.

The sleeve members 14 and 20 of telescoping arms 4 and 6 are between twenty two and twenty four inches long, and the insert members 16 and 22 are the same length, or about the same length, as the sleeve members in which they are received. The insert members 16 and 22 may be pulled outward from their respective sleeve members far enough to provide a guide path 8 from about forty inches in length to about forty six inches. When fully inserted into their respective sleeve members, the guide path 8 is shortened to about twenty two to twenty four inches, i.e. the length of the sleeve members 14 and 20.

Figure 2:
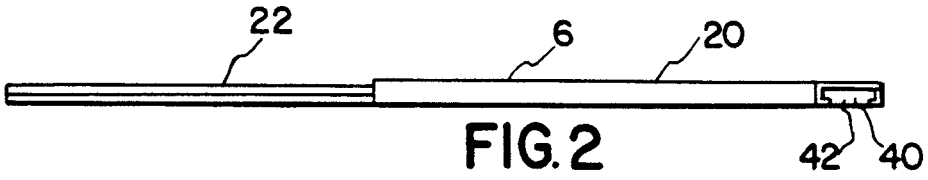
FIG. 2 is a side elevation view of the telescoping leg shown to the right of the guide path in FIG. 1 and with the crossbar insert removed to show its receiving sleeve cavity.
Figure 3:
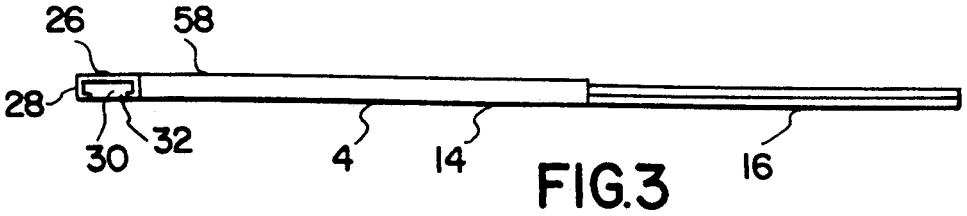
FIG. 3 is a side elevation view of the telescoping leg shown to the left of the guide path in FIG. 1 and with the crossbar insert removed to show its receiving sleeve cavity.
Figure 4:
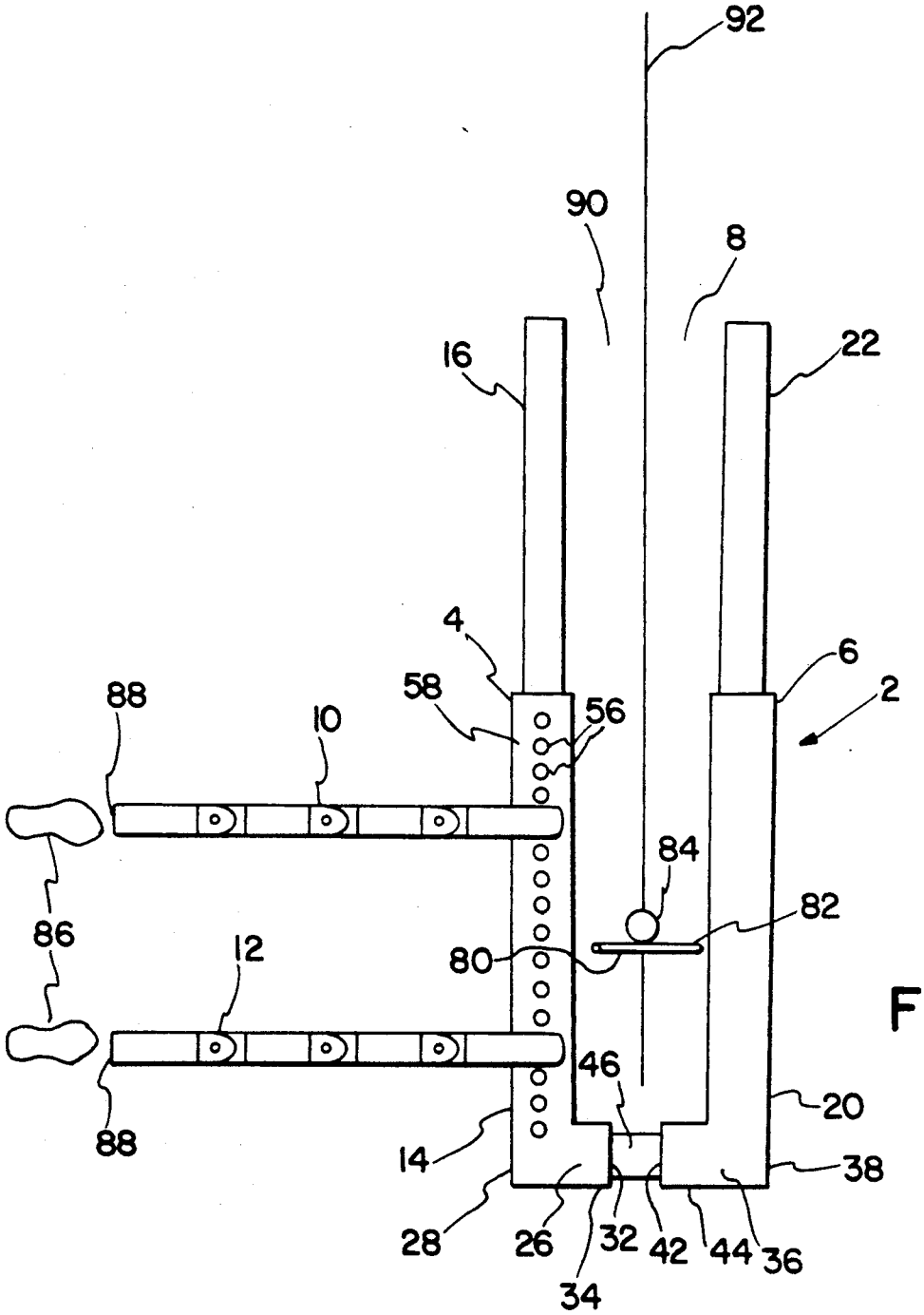
FIG. 4 is a plan view of the golf trainer shown in FIG. 1 but with the telescoping legs on opposite sides of the guide path pushed toward each other a selected distance to narrow the guide path to a width corresponding to that of a club head between its heel and its toe with minimal clearance at each side of about a half inch or less.
Figure 5:
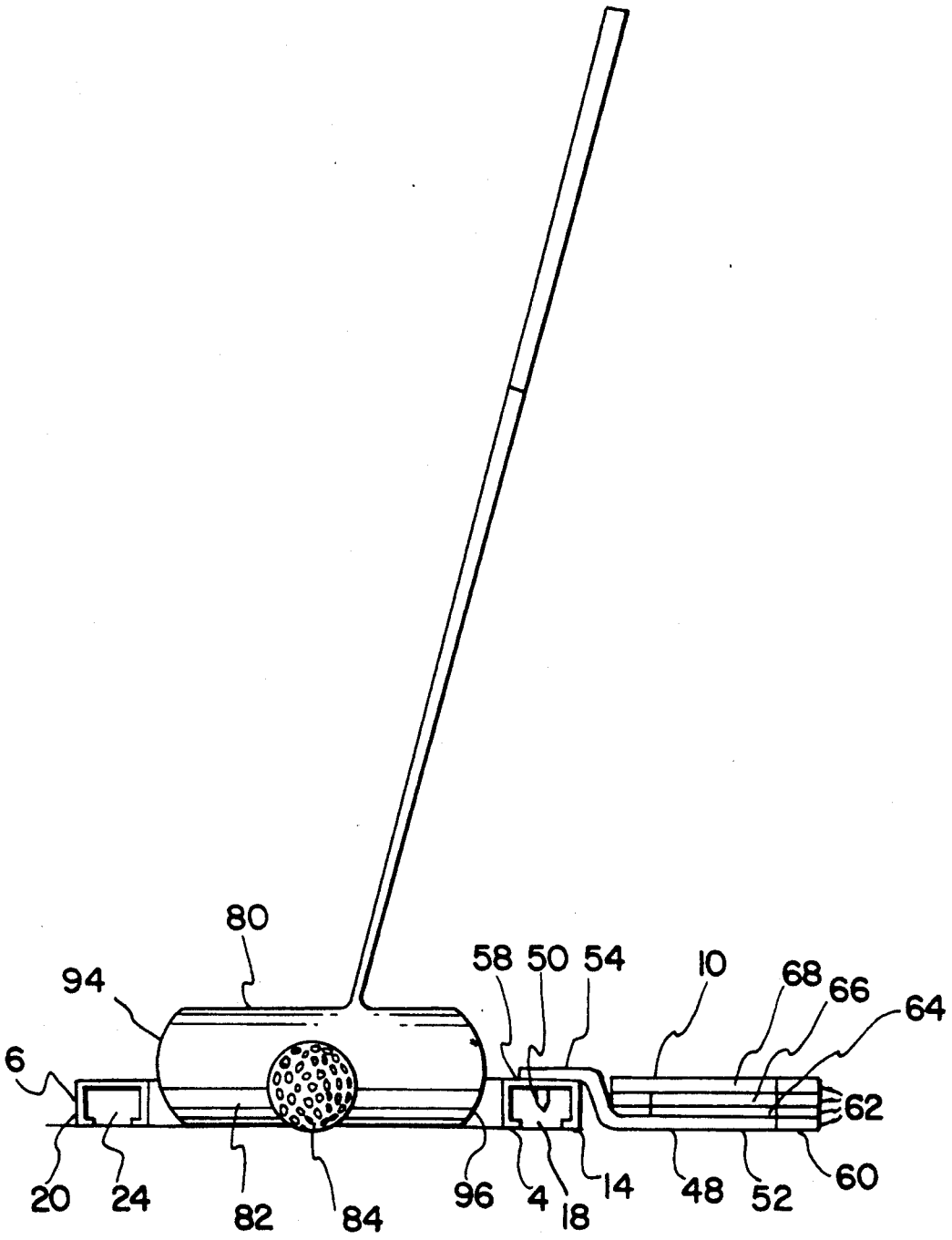
FIG. 5 is an elevation view from the front of a golf trainer in accordance with this invention, showing a golf club and ball in position to be a addressed by the golfer, showing the foot positioning members in their folded position prior to being unfolded to set the foot position of the golfer, and with the elongated inserts of the telescoping legs removed to show their receiving recesses.
Figure 6:
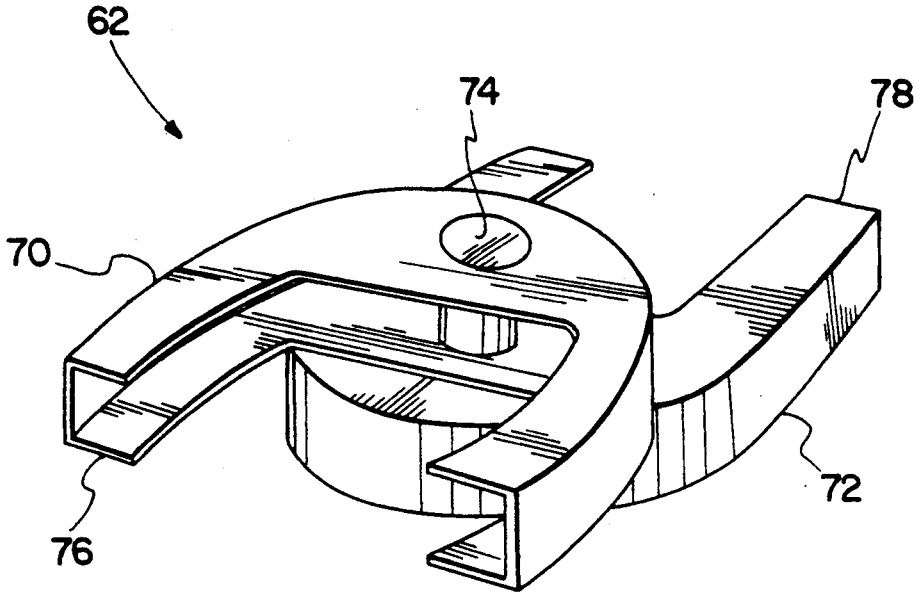
FIG. 6 is a perspective view of the pivot connectors to pivotally connect the foldable strips of the adjustable foot positioning members of the embodiment of the invention which is shown and described herein.
Figure 7:
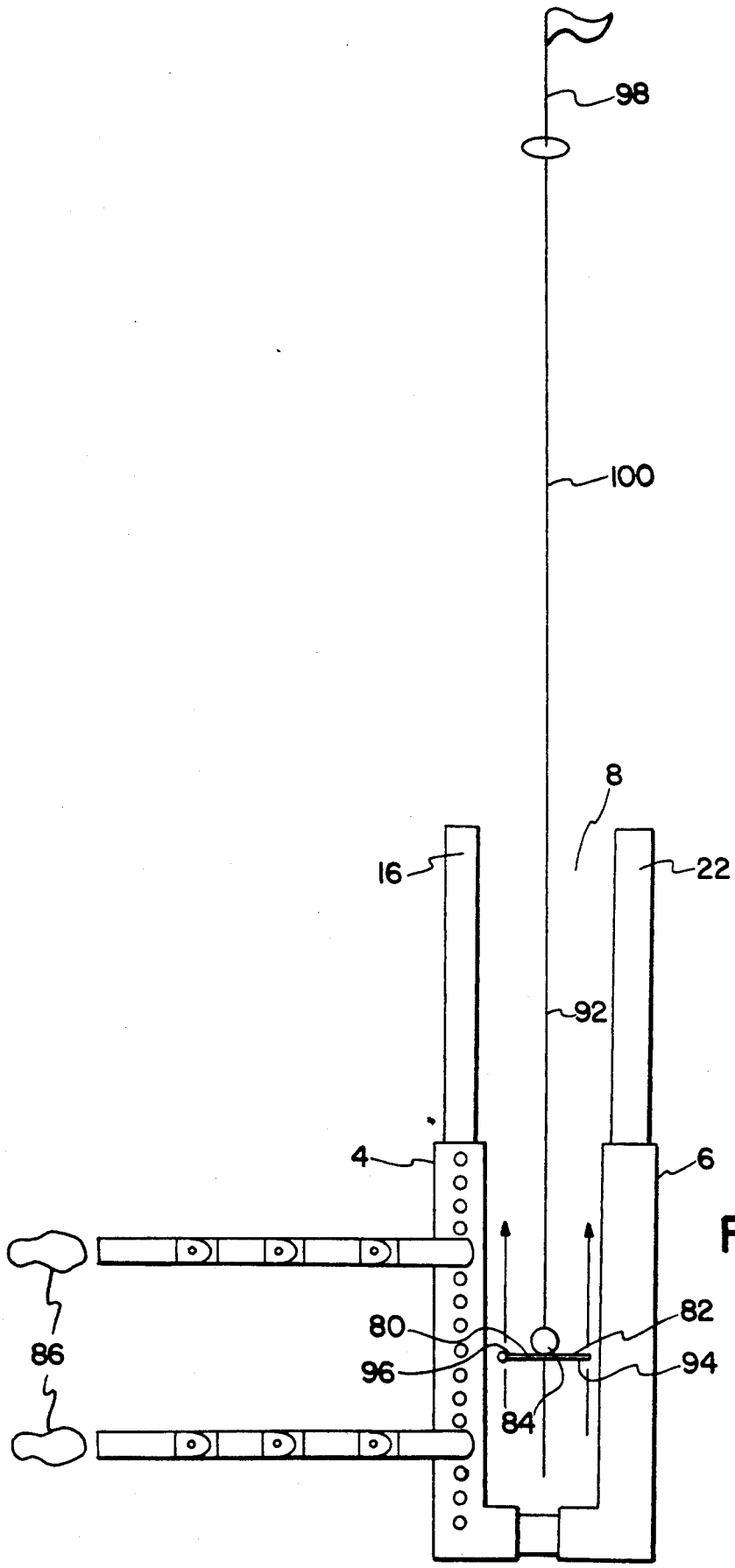
FIG. 7 is a plan view of the golf trainer in accordance with this invention showing the position of the golf ball, the golfer's feet and the head of a golf club in the address position to hit a straight drive and a diagrammatic view of the line of flight to the intended target.
Figure 8:
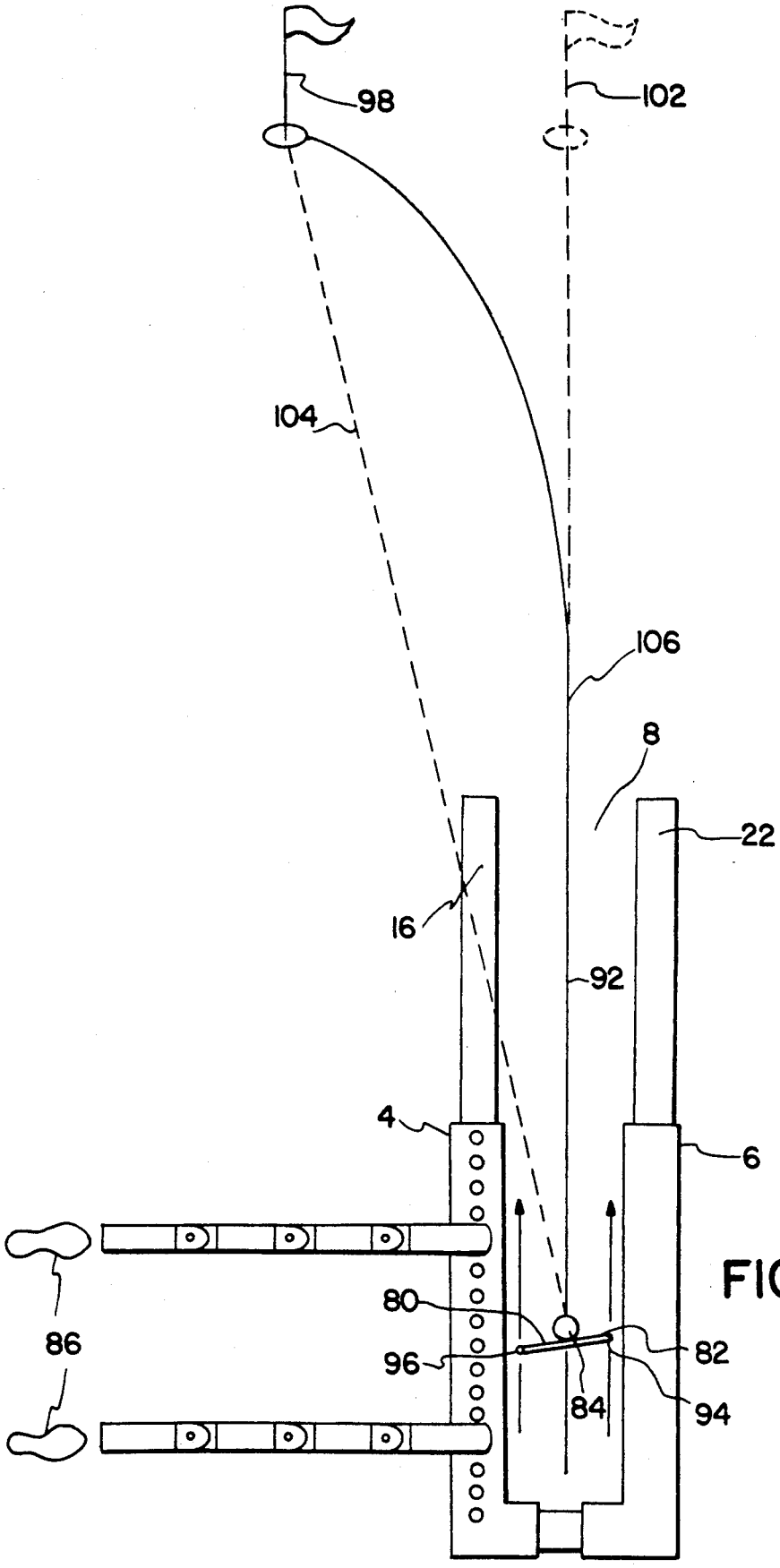
FIG. 8 is a plan view of the golf trainer in accordance with this invention showing the position of the golf ball, golfer's feet and the head of a golf club in the address position to hit a draw, sometimes called a hook, and a diagrammatic view of the curved line of flight toward the left representing a draw or hook, of a straight partially broken line to an imaginary target aimed at to the right of the actual target, and of a broken straight line from the golf ball to the actual target which intersects the face o the club head at a right angle.
Figure 9:
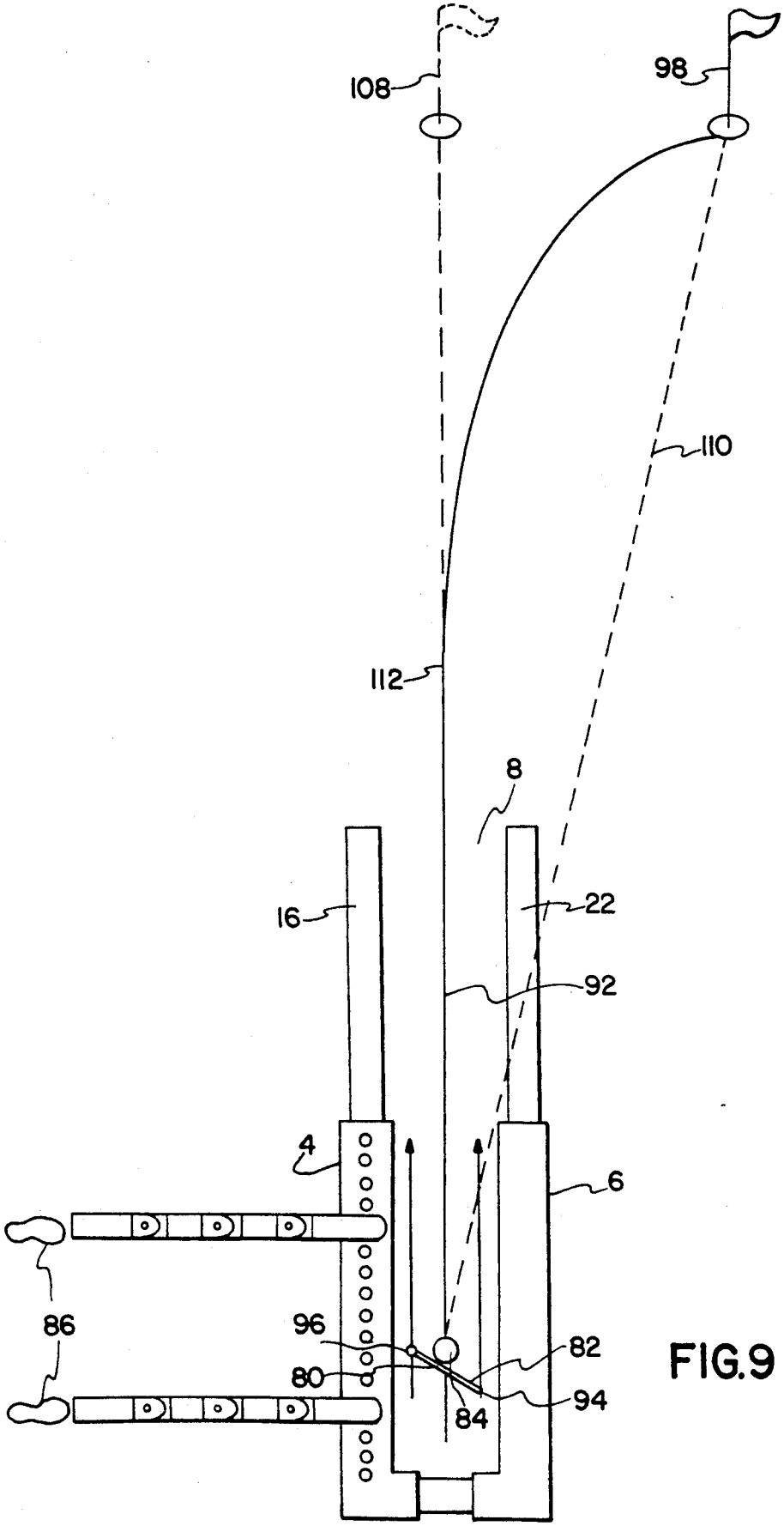
FIG. 9 is a plan view of the golf trainer in accordance with this invention showing the position of the golf ball, golfer's feet and the head of a golf club in the address position to hit a fade, also sometimes called a slice, and a diagrammatic view of the curved line of flight toward the right representing a fade or slice, of a straight partially broken line to an imaginary target aimed at to the left of the actual target, and of a broken straight line from the golf ball to the actual target which intersects the face of the club head at a right angle.

The sleeve members 14 and 20 have a planar upper surface as shown in FIG. 5 which is spaced apart above the ground a distance less than the diameter of the golf ball 84. The crossbar insert 46 and the recess 30 and 40 of the short sleeve members 26 and 36 in which it is receivable have the corresponding cross-sectional configuration and dimension as described hereinabove. Such cross-sectional configuration includes a planar upper surface as seen in FIGS. 2 and 3, which also shows the planar upper surface of the recesses 30 and 40 as well as of the insert 46 when received therein to lie in a plane below that in which the planar upper surface of the sleeve members 14 and 20 lie.

The length of the guide path 8 may thus be adjusted for use of this trainer device at any distance between about twenty two inches and about forty six inches.

When used for perfecting the golfer's putting, the trainer or positioning and aiming device 2 is placed on the green with the open end 90 of guide path 8 toward the hole and spaced apart from the hole about five to seven feet.

The parallel spaced apart telescoping arms 4 and 6 are directed so that the longitudinal axis 92 of the guide path 8 is in line with the line of the putt.

The spacing of the telescoping arms 4 and 6 to determine the width of the guide path 8 is adjusted by sliding the short sleeve member 26 of the first telescoping arm 4 toward or away from the short sleeve member 36 of the second telescoping arm 6 on the crossbar insert 46 whose opposite end portions are received in respective ones of short sleeve recesses 30 and 40 of the short sleeve members 26 and 36. The width of guide path 8 is selected which corresponds to the dimension of the putter head between its toe and its heel with minimal clearance at each side between the putter head and telescoping arms 4 and 6.

The golfer takes his position outward from and facing the first telescoping arm 4, with his feet, knees, hips and shoulders parallel thereto and to the longitudinal axis of guide path 8.

The position of the golfer's feet is marked by placing the pivot pin 50 of connecting strip 48 of one of the foot positioning members 10 and 12 in the aperture 56 of telescoping arm 4 which is in line with the golfer's left foot, and pivot pin 50 of connecting strip 48 of the other one of the foot positioning members in the aperture 56 of telescoping arm 4 which is in line with the golfer's right foot.

The adjustable strips 64, 66 and 68 are then pivoted outwardly as needed to the first, second or third length adjustable positions to reach the distance the golfer's feet are from the telescoping arm 4 of the trainer 2. Such distance of each foot from telescoping arm 4 is thus marked, and the golfer can then step back to make sure the telescoping arms 4 and 6, and longitudinal axis 92 of the guide path 8 are correctly lined up relative to the line of putt. The golfer then resumes his address position and places the head of the putter behind the ball between the telescoping arms 4 and 6.

The golfer then brings the head 80 of the putter back and swings forward in a smooth stroke keeping the head of the putter between the telescoping arms 4 and 6, with its face square to the line of putt or at a right angle thereto, throughout the entire stroke. The length of the putting stroke is adjusted to obtain the desired distance of the putt.

The trainer or positioning and aiming device 2 may be used for chip shots and short pitches in the same manner as for putting.

It may also be used to perfect long drives off the tee and fairway. The feet 86 should be shoulder length apart and back from the telescoping arm 4 the necessary distance for the club head of the club being used to rest on the ground behind the ball in the address position. The telescoping arms 4 and 6 are adjusted to a spaced apart position which provides about a half inch clearance from the respective toe 94 and heel 96 portion of the club head facing respective ones of the arms 4 and 6.

For a straight drive, the longitudinal axis 92 of the guide path 8 between telescoping arms 4 and 6 is directed at the intended target 98, whether the flag on the green or a selected landing spot on the fairway. The club face is square to the line of flight 100 from the ball to the intended target, or at a right angle thereto. The golfer's feet, knees, hips and shoulders are parallel to telescoping arms 4 and 6 and the longitudinal axis 92 of guide path 8. The club head 80 is brought back and swung in a smooth swing to strike the ball 84, with the face 82 of the club head square to, or at a right angle to, the line of flight 100 when it strikes the ball.

In certain cases, it may be desirable to hit a draw, also called a hook, or a fade, also called a slice. The trainer 2 may be used to help train a golfer to hit both a draw and a fade whenever desired.

For use in hitting a draw, an imaginary target 102 is selected to the right of the actual or intended target 98 in the case of a right handed golfer. The telescoping arms 4 and 6 and longitudinal axis 92 of the guide path 8 are directed toward the imaginary target 102. The ball 84 is placed midway between the telescoping arms 4 and 6, and the golfer takes his address position outward from telescoping arm 4 with the face 82 of the club head 80 placed square with or at a right angle to, a straight line 104 between the ball and the actual target 98, not square with the initial line of flight 106 which will be toward the imaginary target 102 to the right of the actual target but at an oblique angle to such initial line of flight 106. The golfer's feet, knees, hips and shoulders are kept parallel to the telescoping arms 4 and 6 and longitudinal axis 92 of the guide path 8 directed toward the imaginary target 102. The golfer then swings the club as he would on a normal swing, bringing the club face 82 between the telescoping arms 4 and 6 for about ten to twelve inches behind the ball 84 as the club face approaches and the ball is struck, then following through with the club around the left side of the golfer's body. This use of the trainer 2 results in the golfer putting a counter-clockwise spin on the ball 84 when it is struck, whereby it starts its line of flight toward the imaginary target 102 but the counter-clockwise spin causes the ball to curve to the left in flight toward the actual target 98.

For use in hitting a fade, an imaginary target 108 is selected to the left of the actual target 98 in the case of a right handed golfer. The telescoping arms 4 and 6 and longitudinal axis 92 of guide path 8 are directed toward this imaginary target 108. The ball 84 is placed midway between the telescoping arms 4 and 6, and the golfer takes his address position outward from telescoping arm 4 with the face 82 of the club head 80 placed square with or at a right angle to a straight line 110 between the ball and the actual target 98, not square with the initial line of flight 112 which will be toward the left of the actual target 9 but at an oblique angle to such initial line of flight 112. The golfer's feet, knees, hips and shoulders are kept parallel to the telescoping arms 4 and 6 and longitudinal axis 92 of the guide path 8 directed toward the imaginary target. The golfer then swings the club as he would on a normal swing, bringing the club face 82 between the telescoping arms 4 and 6 for about ten t twelve inches behind the ball 84 as the club face approaches and the ball is struck, then following through with the club around the left side of the golfer's body. This use of the trainer 2 results in the golfer putting a clockwise spin on the ball 84 when it is struck, whereby it starts its line of flight toward the imaginary target 108 but the clockwise spin causes the ball to curve to the right in flight toward the actual target 98.

The telescoping arms 4 and 6 may be adjusted to whatever appropriate length desired for the guide path 8 by extending the insert members 16 and 22 or retracting them.

The trainer or positioning and aiming device 2 in accordance with the present invention may include a number of modifications and still be within the scope of this invention. Instead of making the component parts separable one from the other for purposes of carrying and storage, the telescoping legs 4 and 6 may be permanently connected to the crossbar insert 46 on which they are slidable together and apart. For storage they can be pushed completely together until their laterally extending short sleeve members 26 and 36 abut against each other.

The foot positioning members 10 and 12 can also be permanently mounted on the telescoping leg 4 by sleeve members slidable along leg 4 to whatever position desired, and having the foldable segments or strips pivotally secured to such sleeve members. Also such foot positioning members may be length adjustable in ways other than the foldable segments or strips described above as one way of making them length adjustable. They may for example be made in the form of a number of telescoping segments, which when fully retracted comprise compact units that can be folded against the leg 4 to which they are secured for ease in storing and carrying in the user's golf bag.

I claim:

1. A golf training device comprising a longitudinally bounded guide path for placement of a golf ball therein to be struck by a golfer, said guide path having a longitudinal axis, first longitudinally extending boundary means on one side of said longitudinal axis and substantially parallel thereto to bound one side of said guide path, second longitudinally extending boundary means on the opposite side of said longitudinal axis and substantially parallel thereto to bound the opposite side of said guide path, width adjusting connecting means adjustably connecting said first boundary means to said second boundary means to enable moving said first and second boundary means closer together to narrow said guide path and farther apart to widen said guide path, foot positioning means to position a golfer's feet relative to said guide path, a one of said longitudinally extending boundary means including a plurality of spaced apart receiving cavities, said foot positioning means including insert means insertable into said receiving cavities, and adjustable foot positioning connecting means for adjustably connecting and holding said foot positioning means to a one of said longitudinally extending boundary means and against relative longitudinal movement thereof, to adjust the width a said golfer's feet are to be spread apart, said adjustable foot positioning connecting means comprising said insert means of said foot positioning means and said plurality of spaced apart receiving cavities of a one of said longitudinally extending boundary means, said insert means of said foot positioning means being receivable in any selected ones of said plurality of spaced apart receiving cavities of said one of said longitudinally extending boundary means.

2. A golf training device as set forth in claim 1, wherein said first and second longitudinally extending boundary means each include respective first and second boundary length adjusting means to shorten and lengthen each of said first and second longitudinally extending boundary means.

3. A golf training device as set forth in claim 2, wherein said first longitudinally extending boundary means comprises a first elongated longitudinal sleeve member having a first longitudinal sleeve recess therein, said first boundary length adjusting means includes a first elongated insert member slidably receivable in said first longitudinal sleeve recess to adjust the length of said first longitudinally extending boundary means, said second longitudinally extending boundary means comprises a second elongated longitudinal sleeve member having a second longitudinal sleeve recess therein, said second boundary length adjusting means includes a second elongated insert member slidably receivable in said second longitudinal sleeve recess to adjust the length of said second longitudinally extending boundary means, wherein the cross-sectional dimension and configuration of said first and second longitudinal sleeve recesses corresponds to that of said first and second elongated insert members slidably receivable in respective ones of said longitudinal sleeve recesses to provide a close frictional fit which permits said elongated insert members to slide relative to said longitudinal sleeve members in which they are respectively receivable and the frictionally hold in place when sliding movement thereof has been discontinued.

4. A golf training device as set forth in claim 1, wherein said width adjusting connecting means includes a laterally extending width adjustment connecting member extending between said first and second longitudinally extending width adjustment connecting member extending between said first and second longitudinally extending boundary means, said first longitudinally extending boundary means includes first receiving means to receive an adjacent portion of said laterally extending width adjustment connecting member, said second longitudinally extending boundary means includes second receiving means to receive an adjacent portion of said laterally extending width adjustment connecting member, said longitudinally extending boundary means being low profile having a planar upwardly facing surface throughout which is spaced apart from and above the ground a distance less than the diameter of a golf ball, said width adjustment connecting member having a planar upwardly facing surface throughout, said upwardly facing surface of said width adjusting connecting member lying in a plane no higher above the ground than does that of the planar upwardly facing surface of said low profile longitudinally extending boundary means when said width adjusting connecting member is received therein.

5. A golf training device as set forth in claim 4, wherein said first longitudinally extending boundary means includes a first elongated boundary member, said first receiving means to receive said portion of said laterally extending width adjustment connecting member adjacent thereto includes a first receiving member on said first elongated member, said first receiving member having a passageway to slidably receive said portion of said laterally extending width adjustment member therein, said second longitudinally extending boundary means includes a second elongated boundary member, said second receiving means to receive said portion of said laterally extending width adjustment member adjacent thereto includes a second receiving member on said second elongated member, said second receiving member having a passageway to slidably receive said portion of said laterally extending width adjustment member therein, wherein the cross-sectional configuration and dimension of said passageways of said first and second receiving members corresponds to that of said portions of said width adjustment connecting member slidably received in respective ones of said passageways to provide a close frictional fit which permits said width adjustment member to slide relative to said passageways and to frictionally hold in place when sliding movement thereof has been discontinued.

6. A golf training device as set forth in claim 5, wherein said first receiving member of said first elongated boundary member comprises a first lateral sleeve member extending laterally from one end of said first elongated boundary member, said passageway thereof comprises a first lateral sleeve recess opening in the direction toward said longitudinal axis of said guide path, said second receiving member of said second elongated receiving member comprises a second lateral sleeve member extending laterally from one end of said second elongated boundary member, said passageway thereof comprises a second lateral sleeve recess opening in the direction toward said longitudinal axis of said guide path, said first and second lateral sleeve recesses being axially aligned, said respective portion of said width adjustment connecting member adjacent said passageways of said first and second receiving members being slidably received in respective ones of said first and second lateral sleeve recesses and frictionally held therein to frictionally hold said elongated boundary members at a pre-selected spaced apart distance.

7. A golf training device as set forth in claim 1, wherein said first longitudinally extending boundary means comprises an elongated longitudinal member having a planar upper surface and a plurality of longitudinally spaced apart apertures opening to said planar upper surface, said spaced apart apertures comprising said spaced apart receiving cavities, said foot positioning means being connected to said elongated longitudinal member, said foot positioning means including a first foot positioning member having a first pivot pin to seat in a selected first one of said longitudinally spaced apart apertures, a second foot positioning member having a second pivot pin to seat in a selected second one of said longitudinally spaced apart apertures, said pivot pins comprising said insert means of said foot positioning means.

8. A golf training device as set forth in claim 7, wherein said first and second foot positioning members each include respective first and second foot positioning length adjustment means to shorten and lengthen each of said first and second foot positioning members.

9. A golf training device as set forth in claim 8, wherein said first foot positioning length adjustment means includes a first plurality of elongated members each having respective ends pivotally connected to adjacent ones of said first plurality of elongated members for pivoting thereof between a fully shortened position and a fully extended position, said second foot positioning length adjustment means includes a second plurality of elongated members each having respective ends pivotally connected to adjacent ones of said second plurality of elongated members for pivoting thereof between a fully shortened position and a fully extended position.

10. A golf training device as set forth in claim 1, wherein said first and second longitudinally extending boundary means, said width adjusting connecting means connecting said boundary means, said foot positioning means and said adjustable foot positioning connecting means are arrangeable in an expanded assembled position for use and a compact collapsed position for storing and carrying.

* * * * *

UNITED STATES PATENT OFFICE

CERTIFICATE OF CORRECTION

Patent No. 5,014,994 Dated May 14, 1991

Inventor(s) Dennis W. Peters

It is certified that error appears in the above-identified patent and that said Letters Patent is hereby corrected as shown below:

In column 2, line 64, after "face" delete "o" and insert - -of- -.

In column 4, line 13, after "telescoping" delete "arms" and insert - -arm- -.

In column 5, line 1, after "strip" delete the number "6" and insert - -68- -.

In column 7, line 54, after "target" delete the number "9" and insert - -98- -.

In column 7, line 60, after "ten" delete "t" and insert - -to- -.

In column 9, Claim 4, lines 29-31, delete "width adjustment connecting member extending between said first and second longitudinally extending"

In column 10, Claim 6, line 21, change "portion" to - -portions- -.

Signed and Sealed this

Fifteenth Day of September, 1992

*Attest:*

*Attesting Officer*

DOUGLAS B. COMER

*Acting Commissioner of Patents and Trademarks*